US006434959B2

(12) United States Patent
Kobayashi et al.

(10) Patent No.: US 6,434,959 B2
(45) Date of Patent: Aug. 20, 2002

(54) AIR CONDITIONER

(75) Inventors: Kenji Kobayashi, Nitta-machi; Haruyuki Kaeriyama, Ota; Naoki Tsuzurano, Nitta-machi; Shigetaka Nishino; Shinichi Ito, both of Oizumi-machi; Takeshi Ogawa, Ashikaga, all of (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/731,409

(22) Filed: Dec. 6, 2000

(30) Foreign Application Priority Data

Dec. 7, 1999 (JP) ..... 11-347166
Dec. 7, 1999 (JP) ..... 11-347167

(51) Int. Cl.[7] ..... F25B 13/00

(52) U.S. Cl. ..... 62/180; 62/222; 62/114; 62/174; 62/502

(58) Field of Search ..... 62/114, 149, 174, 62/222, 223, 224, 225, 204, 210, 211, 212, 181, 183, 184, 186, 502, 180

(56) References Cited

U.S. PATENT DOCUMENTS 4,179,898 A * 12/1979 Vakil ..... 62/174 X
4,913,714 A * 4/1990 Ogura et al. ..... 62/149
5,140,827 A 8/1992 Reedy ..... 62/174
5,385,030 A 1/1995 Kitagawa et al. ..... 62/160
5,768,902 A 6/1998 Nonaka et al. ..... 62/183
5,799,497 A * 9/1998 Sano et al. ..... 62/502 X
5,822,966 A 10/1998 Sienel et al. ..... 62/114
5,829,262 A 11/1998 Urata et al. ..... 62/174
5,848,537 A 12/1998 Biancardi et al. ..... 62/324.6
5,987,907 A * 11/1999 Morimoto et al. ..... 62/502 X

FOREIGN PATENT DOCUMENTS

EP 0685692 A2 12/1995
EP 0715134 A2 6/1996

* cited by examiner

*Primary Examiner*—Harry B. Tanner
(74) *Attorney, Agent, or Firm*—Darby & Darby

(57) ABSTRACT

In an air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of first refrigerant having a high boiling point and second refrigerant having a low boiling point being filled in the refrigerant circuit and the flow of the non-azeotropic mixture refrigerant being inverted between cooling operation and heating operation by operating the four-way valve, when one of the outdoor heat exchanger and the indoor heat exchanger serves as an evaporator, the first refrigerant of the non-azeotropic mixture refrigerant is stocked in the accumulator while the second refrigerant of the non-azeotropic mixture refrigerant is circulated in the refrigerant circuit, thereby increasing the refrigerant pressure in the evaporator.

8 Claims, 4 Drawing Sheets

10
12
11
9
15
27
21
22
28
23
EC
P
17
16
18
14
25
26
19
13
CONT-
ROLLER
20
COOLING CYCLE
HEATING CYCLE

AIR CONDITIONER

BACKGROUND OF THE INVENTION

1. Field of the Invention

The present invention relates to an air conditioner using non-azeotropic mixture refrigerant composed of refrigerant having a high boiling point and refrigerant having a low boiling point.

2. Description of the Related Art

In a heat pump type air conditioner, a compressor, a four-way valve, an outdoor heat exchanger, a pressure-reducing mechanism, an indoor heat exchanger and an accumulator are arranged so as to be successively connected to one another in this order, thereby constructing a loop-like refrigerant circuit. According to this type air conditioner, the refrigerant is circulated through the above parts in the above order under cooling operation by operating the four-way valve, whereby the indoor heat exchanger serves as an evaporator while the outdoor heat exchanger serves as a condenser). On the other hand, the refrigerant is circulated through the above parts in the opposite order to the above order, whereby the indoor heat exchanger serves as a condenser (the outdoor heat exchanger serves as an evaporator).

Recently, from the viewpoint of preventing the destruction of the ozone layer, there has been such a tendency that non-azeotropic mixture refrigerant composed of the mixture of refrigerant having a high boiling point and refrigerant having low boiling point, such as R407C or the like is used as refrigerant for air conditioners. Further, particularly in North America, cooling operation is carried out even in the winter season under which outdoor temperature is low because an air conditioner is put in a computer room or both of a heat source machine and an air conditioner are put side by side in most cases.

When non-azeotropic mixture refrigerant as described above is used, the refrigerant in the evaporator is harder to evaporate as compared with the case where single refrigerant such as R22 or the like is used, and thus the refrigerant pressure in the evaporator is reduced. Therefore, for example when cooling operation is carried out in such an air conditioner under a state where the outside temperature is low, freezing is liable to occur in the indoor heat exchanger. If the freezing is grown, the indoor heat exchanger would be broken, or the evaporation of the refrigerant in the indoor heat exchanger would be insufficient, so that liquid-back to the compressor occurs and thus the compressor is broken. Therefore, in order to avoid the above disadvantage, in the cooling operation under the state that the outdoor temperature is low, the compressor is stopped at the time when occurrence of the freezing in the indoor heat exchanger starts. However, such a control operation to the air conditioner makes it impossible to carry out the cooling operation continuously, so that a stable cooling effect cannot be achieved.

Further, when heating operation is carried out in such an air conditioner as described above, frost is also liable to occur in the outdoor heat exchanger serving as an evaporator even under the cooling operation standard condition of JIS. When frost is liable to occur in the outdoor heat exchanger in the heating operation, the heating, operation must be stopped for a long time to carry out a defrost operation, resulting in reduction in the heating power.

SUMMARY OF THE INVENTION

The present invention has been implemented in view of the foregoing situation, and has an object to provide an air conditioner which can suppress occurrence of freezing in an indoor heat exchanger and thus show a stable cooling effect in cooling operation under a state where the outside temperature is low even when non-azeotropic mixture refrigerant is used.

Another object of the present invention is to provide an air conditioner which can suppress occurrence of frost in an Outdoor heat exchanger in heating operation and thus enhance the heating power.

In order to attain the above objects, according to a first aspect of the present invention, an air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of first refrigerant having a high boiling point and second refrigerant having a low boiling point being filled in the refrigerant circuit and the flow of the non-azeotropic mixture refrigerant being inverted between cooling operation and heating operation by operating the four-way valve, is characterized in that when one of the outdoor heat exchanger and the indoor heat exchanger serves as an evaporator, the first refrigerant of the non-azeotropic mixture refrigerant is stocked in the accumulator while the second refrigerant of the non-azeotropic mixture refrigerant is circulated in the refrigerant circuit, thereby increasing the refrigerant pressure in the evaporator.

According to a second aspect of the present invention, an air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of first refrigerant having a high boiling point and second refrigerant having a low boiling point being, filled in the refrigerant circuit and the flow of the non-azeotropic mixture refrigerant being inverted between cooling operation and heating operation by operating the four-way valve, is characterized in that in cooling operation under a state where the outside temperature is low, the first refrigerant of the non-azeotropic mixture refrigerant is stocked in the accumulator while the second refrigerant of the non-azeotropic mixture refrigerant is circulated in the refrigerant circuit, thereby increasing the refrigerant pressure in the evaporator.

In the air conditioner of the second aspect of the present invention, the stock of the first refrigerant into the accumulator is performed by increasing the valve opening degree of the pressure-reducing mechanism (expansion valve) when the temperature of the refrigerant flowing in the indoor heat exchanger is equal to a first predetermined temperature or less.

In the air conditioner of the second aspect of the present invention, when the temperature of the refrigerant flow in the indoor heat exchanger is equal to a second predetermined temperature or less, the second predetermined temperature being lower than the first predetermined temperature, the number of revolution of an indoor fan for blowing air to the indoor heat exchanger is increased.

In the air conditioner of the second aspect of the present invention, the number of revolution of an outdoor fan for blowing air to the outdoor heat exchanger is set to any one of plural levels in accordance with the outside temperature.

According to the second aspect of the present invention, in the cooling operation under the state where the outside temperature is low, the first refrigerant (the refrigerant having the high boiling point) of the non-azeotropic mixture refrigerant is stocked in the accumulator, and the second refrigerant (the refrigerant having the low boiling point) of the non-azeotropic mixture refrigerant is circulated in the refrigerant circuit. Therefore, the refrigerant in the indoor heat exchanger serving as the evaporator in the cooling operation is more liable to evaporate, and thus the refrigerant pressure in the indoor heat exchanger is increased. Therefore, occurrence of freezing in the indoor heat exchange r can be suppressed in the cooling operation under the state where the outside temperature is low.

Accordingly, the frequency at which the compressor must be stopped in order to prevent the indoor heat exchanger or the compressor from being broken due to occurrence of the freezing can be remarkably reduced. Therefore, even when the non-azeotropic mixture refrigerant is used, the cooling operation can be continuously carried out under the state where the outdoor temperature is low. As a result, the stable cooling effect can be realized, and an excellent comfortable environment can be achieved.

Further, since the refrigerant having the high boiling point is positively stocked in the accumulator in the cooling operation under the state where the outside temperature is low, there is not required any receiver tank which has been hitherto disposed to avoid the refrigerant from being stocked in the accumulator, and this also enables omission of a pressure-reducing mechanism which has been hitherto required to be disposed in the neighborhood of the outdoor heat exchanger due to the disposition of the receiver tank. As a result the refrigerant circuit can be simplified in construction and the cost thereof can be lowered.

Still further, when the number of revolution of the indoor fan for blowing air to the indoor heat exchanger is increased, the refrigerant flowing in the indoor heat exchanger is more liable to evaporate, so that the refrigerant pressure in the indoor heat exchanger is increased and the refrigerant temperature is increased. As a result, the refrigerant pressure in the indoor heat exchanger serving as the evaporator is increased by circulating the refrigerant having the low boiling point of the non-azeotropic mixture refrigerant, whereby the effect of suppressing occurrence of the freezing in the indoor heat exchanger can be enhanced and thus the occurrence of the freezing in the indoor heat exchanger can be more surely suppressed.

In addition, by stepwise adjusting the number of revolution of the outdoor fan for blowing air to the outdoor heat exchanger in accordance with the outside temperature, the refrigerant in the outdoor heat exchanger serving as the condenser is harder to be condensed, so that the refrigerant pressure in the outdoor heat exchanger is increased and the refrigerant temperature is also increased. This increases the, refrigerant pressure in the indoor heat exchanger serving as the evaporator and also increases the refrigerant temperature, so that the occurrence of the freezing in the indoor heat exchanger can be more surely suppressed.

According to a third aspect of the present invention, an air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of first refrigerant having a high boiling point and second refrigerant having a low boiling point being filled in the refrigerant circuit and the flow of the non-azeotropic mixture refrigerant being inverted between cooling operation and heating operation by operating the four-way valve, is characterized in that in heating operation, the first refrigerant of the non-azeotropic mixture refrigerant is stocked in the accumulator while the second refrigerant of the non-azeotropic mixture refrigerant is circulated in the refrigerant circuit, thereby increasing the refrigerant pressure in the evaporator.

In the third aspect of the present invention, the stock of the first refrigerant into the accumulator is performed by setting the valve opening degree of an expansion valve serving as the pressure-reducing mechanism on the basis of the room temperature when the heating operation is started and on the basis of a target discharged refrigerant temperature after a predetermined time elapses from the start of the heating operation.

In the third aspect of the present invention, the stock of the first refrigerant into the accumulator on the basis of the room temperature is performed by setting the valve opening degree of the expansion valve to a predetermined fixed opening degree.

In the third aspect of the present invention, the stock of the first refrigerant into the accumulator is performed by setting the valve opening degree of the expansion valve on the basis of the temperature difference between the actual discharged refrigerant temperature of the refrigerant discharged from the compressor and a predetermined target discharged refrigerant temperature so that the temperature difference is equal to zero.

According to the air conditioner of the third aspect of the present invention, under the heating operation, the refrigerant having the high boiling point of the non-azeotropic mixture refrigerant is stocked in the accumulator and the refrigerant having the low boiling point is circulated in the refrigerant circuit, so that the refrigerant in the outdoor heat exchanger serving as the evaporator in the heating operation is more liable to evaporate and thus the refrigerant pressure in the outdoor heat exchanger is increased, thereby suppressing the frost in the outdoor heat exchanger. Therefore, the ratio of the defrost operating time to the heating operation is reduced. Further, since the refrigerant having the low boiling point is circuited in the refrigerant circuit under the heating operation, the refrigerant pressure in the indoor heat exchanger serving as the condenser is increased and thus the heating power of the indoor heat exchanger can be enhanced. As a result, the heating power under the heating operation as the whole air conditioner can be enhanced.

Further, since the refrigerant having the high boiling point is stocked in the accumulator under the heating operation, there is not required any receiver tank which has been hitherto disposed to avoid the refrigerant from being stocked in the accumulator in the refrigerant circuit, and this also enables omission of a pressure-reducing mechanism which has been disposed in the neighborhood of the outdoor heat exchanger because of the disposition of the receiver tank. As a result, the refrigerant circuit can be simplified in construction and the cost thereof can be lowered.

According to a fourth aspect of the present invention, an air conditioner including a, compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of at least one first refrigerant having a high boiling point and at least one second refrigerant having a low boiling point being filled in the refrigerant circuit and the flow of the non-azeotropic mixture refrigerant being inverted between cooling operation and heating operation by operating the four-way valve, is characterized by further including: a controller for controlling the pressure-reducing degree of said pressure-reducing mechanism so that when the heating operation is: carried out or the cooling operation under a low outside temperature is carried out, the first refrigerant of the non-azeotropic mixture refrigerant is stocked in said accumulator and the second refrigerant of the non-azeotropic mixture refrigerant is circulated in said refrigerant circuit, thereby increasing the refrigerant pressure in said evaporator.

According to the air conditioner of the fourth aspect of the present invention, the pressure-reducing degree of said pressure-reducing mechanism is controlled by the controller so that when the heating operation is carried out or the cooling operation under a low outside temperature is carried out, the first refrigerant of the non-azeotropic mixture refrigerant is stocked in said accumulator and the second refrigerant of the non-azeotropic mixture refrigerant is circulated in said refrigerant circuit, thereby increasing the refrigerant pressure in said evaporator. Therefore, the refrigerant in each of the outdoor heat exchanger and the indoor heat exchanger when they serves as the evaporator in the heating operation or in the cooling operation under the low outside temperature state is more liable to evaporate and thus the refrigerant pressure in the evaporator is increased, thereby suppressing the freezing or frost in the evaporator.

DETAILED DESCRIPTION OF THE PREFERRED EMBODIMENTS

Preferred embodiments according to the, present invention will be described hereunder with reference to the accompanying drawings.

Figure 1:
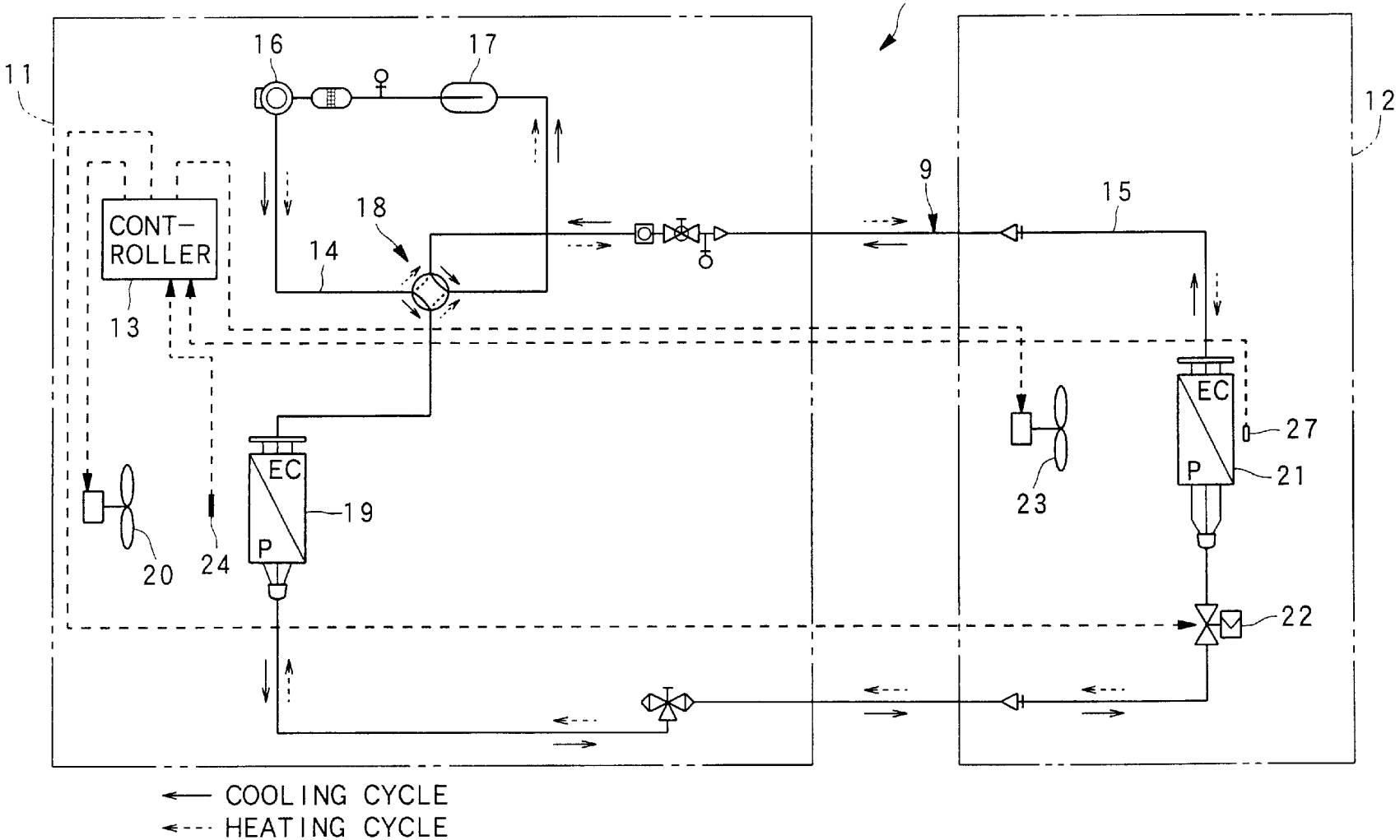
FIG. 1 is a diagram showing a refrigerant circuit according to a first embodiment of an air conditioner of the present invention.

FIG. 1 is a diagram showing a refrigerant circuit according to a first embodiment of an air conditioner (heat pump type air conditioner) of the present invention.

As show in FIG. 1, a heat pump type air conditioner 10 of this embodiment includes an outdoor unit 11, an indoor unit 12 and a controller 13, and an outdoor refrigerant pipe 14 of the outdoor unit 11 and an indoor refrigerant pipe 15 of the indoor unit 12 are linked to each other.

The outdoor unit 11 is disposed outdoors, and it includes a compressor 16, an accumulator 17 disposed at the suction side of the compressor 16, a four-way valve 18 disposed at the discharge side of the compressor 16 and an outdoor heat exchanger 19 at the four-way valve (18) side, these parts being disposed so as to be connected to one another through the outdoor refrigerant pipe 14. In addition, an outdoor fan 20 for blowing air to the outdoor heat exchanger 19 is disposed adjacently to the outdoor heat exchanger 19.

The indoor unit 12 is disposed in a room, and it includes an indoor heat exchanger 21 and an expansion valve 22 serving as a pressure-reducing mechanism disposed in the neighborhood of the indoor heat exchanger 21, these parts being disposed so as to be connected to each other through the indoor refrigerant pipe 15. An indoor fan 23 for blowing air to the indoor heat exchanger 21 is disposed so as to be adjacent to the indoor heat exchanger 21.

By linking the indoor refrigerant pipe 14; and the indoor refrigerant pipe 15 to each other, the accumulator 17, the compressor 16, the four-way valve 18, the outdoor heat exchanger 19, the expansion valve 22 and the indoor heat exchanger 21 are successively linked to one another in this order, and the accumulator 17 is linked through the four-way valve 18 to the indoor heat exchanger 21, whereby the air conditioner 10 constructs a loop-like refrigerant circuit 9.

The controller 13 controls the operation of the outdoor unit 11 and the indoor unit 12, and specifically it controls the compressor 16, the four-way valve 18 and the outdoor fan 20 of the outdoor unit 11, and the expansion valve 22 and the indoor fan 23 of the indoor unit 12.

The controller 13 switches the four-way valve 18 to set the air conditioner 10 to one of the cooling operation and; the heating operation. That is, when the controller 13 switches the four-way valve 18 to the cooling side, the refrigerant flows in a direction indicated by a solid-line arrow. In this case, the outdoor heat exchanger 19 serves as a condenser, and the indoor heat exchanger 21 serves as an evaporator to keep the air conditioner under the cooling operation. That is, the indoor heat exchanger 21 cools the interior of the room. On the others hand, when the controller 13 switches the four-way valve to the heating side, the refrigerant flows in a direction indicated by a broken-line arrow. In this case, the indoor heat Exchanger 21 serves as the condenser, and the outdoor heat exchanger 19 serves as the evaporator to keep the air conditioner under the heating operation. That is, the indoor heat exchanger 21 heats the interior of the room.

Further, under the cooling operation and the heating operation, the controller 13 controls the valve opening degree of the expansion valve 22 serving as the pressure-reducing mechanism and the number of revolution of each of the outdoor fan 20 and the indoor fan 231 in accordance with the air conditioning load.

According to the first embodiment of the present invention, the controller 13 adjusts the opening degree of the expansion valve 22 and the number of revolution of the outdoor fan 20 and the indoor fan 23 as described later under the cooling operation to perform a cooling control operation under a low outside temperature. Here, the cooling control operation under the low outside temperature means the control of the cooling operation when the outside temperature is low, for example under the, winter season.

Here, the refrigerant used in the air conditioner of the present invention is non-azeotropic mixture refrigerant formed by mixing plural refrigerant materials which are different in boiling point. For example, R407C may be used as the non-azeotropic mixture refrigerant. R407C is three-components refrigerant in which 52 Wt % of R134a, 25 Wt % of R125 and 23 wt % of R32 are mixed. The boiling points of the respective refrigerant materials are as follows: R134a (−26° C.), R125 (−48° C.) and R32 (−52° C.). Accordingly, R125 and R32 are more liable to evaporate because the boiling points thereof are relatively low, and R134a is harder to evaporate because the boiling point thereof is relatively high.

In this embodiment, the controller 13 executed the following cooling control operation under the low outside temperature in the cooling operation so that the refrigerant having the higher boiling point (R134a) of the non-azeotropic mixture refrigerant is stocked in the accumulator 17 while the refrigerant having the lower boiling point (R125 and R32) of the non-azeotropic mixture refrigerant are circulated in the refrigerant circuit 9, thereby varying the composition of the refrigerant circulated in the refrigerant circuit 9.

In order to perform the cooling control operation under the low outside temperature, an outsider temperature sensor 24 is provided to detect the temperature of the outside air sucked to the outdoor heat exchanger 19 (that is, the outside temperature), and the sucked air temperature thus detected is input to the controller 13. Further, an indoor heat exchanger temperature sensor 27 is provided to detect the temperature of the refrigerant flowing at the middle position between the inlet and outlet ports of the indoor heat exchanger 21 (that is, the indoor heat exchanger refrigerant temperature), and the indoor heat exchanger refrigerant temperature thus detected is also input to the controller 13.

Figure 2:
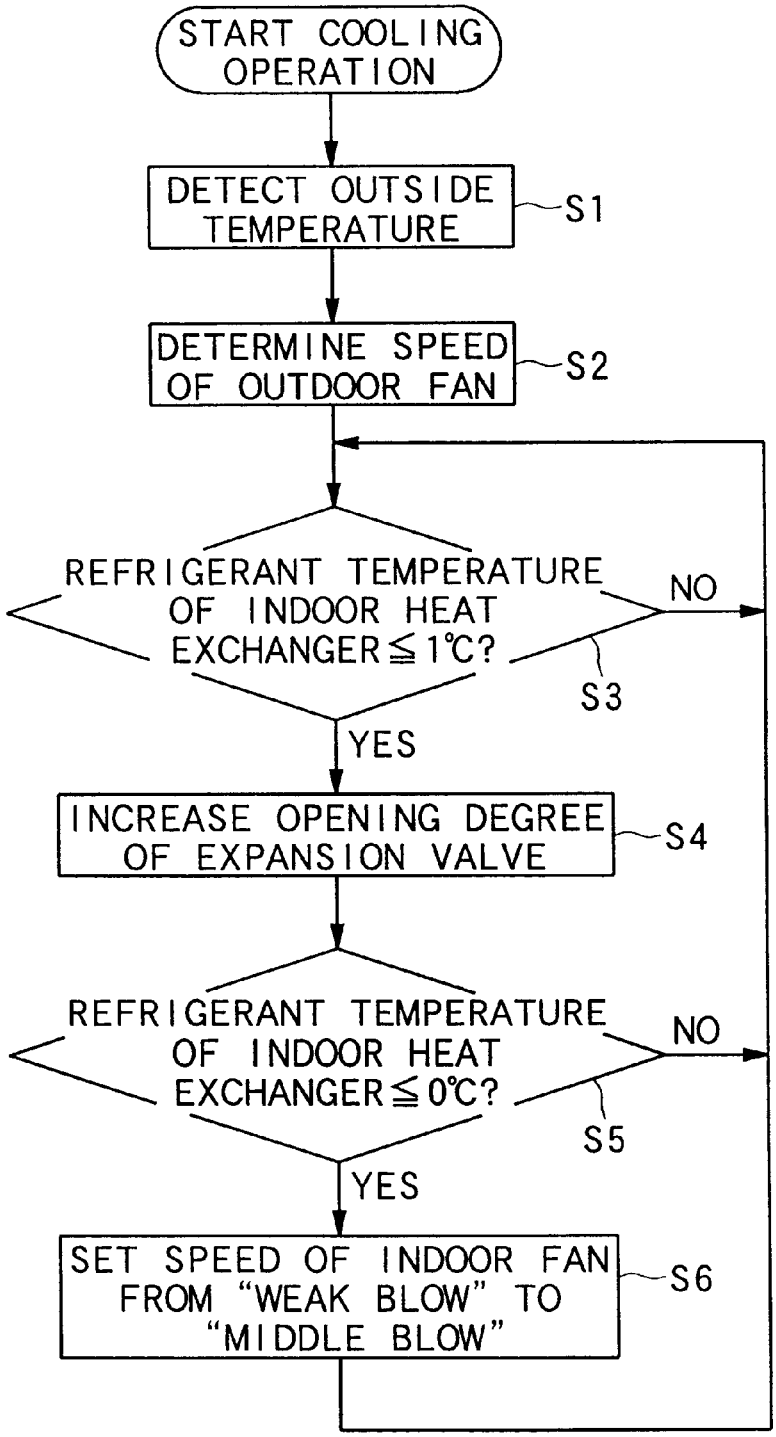
FIG. 2 is a flowchart showing cooling control under low outside temperature in cooling operation of the air conditioner shown in FIG. 1.

Under the cooling operation, the controller 13 carries out the cooling control operation under the low outside temperature as shown in the flowchart of FIG. 2. In the cooling control operation under the low outside temperature, the controller 13 first controls the outside temperature sensor 24 to detect the outside temperature when the cooling operation is started (S1), and sets the number of revolution of the outdoor fan 20 to one of plural levels (for example, three levels) in conformity with the outside temperature thus detected (S2).

The number of revolution of the outdoor fan 20 is stepwise set to "strong blow", "middle blow" and "weak blow" in the decreasing order of blowing intensity. For example, the controller 13 sets the number of revolution of the outdoor fan 20 to "strong blow" when the outside temperature is above 25° C., "middle blow" when the outside temperature is in the range from 7° C. to 25° C., and "weak blow" when the outside temperature is below 7° C.

By reducing the number of revolution of the outdoor fan 20 when the outside temperature is lower, the refrigerant in the outdoor heat exchanger 19 serving as the condenser is harder to evaporate, and the refrigerant pressure in the outdoor heat exchanger 19 is increased and also the refrigerant temperature rises up. As a result, the refrigerant pressure in the indoor heat exchanger 21 serving as the evaporator is increased and also the refrigerant temperature rises up, thereby suppressing occurrence of freezing in the indoor heat exchanger 21.

Subsequently, the controller 13 judges whether the indoor heat exchanger refrigerant temperature detected by the indoor heat exchanger temperature sensor 27 is reduced to a first predetermined temperature (for example, 1° C.) or less (S3). If so, the controller 13 increases the valve opening degree of the expansion valve 22 to a value higher than a normal value (S4). For example, the controller 13 sets the valve opening degree of the expansion valve 22 to 60 steps per 30 seconds.

By increasing the valve opening degree of the expansion valve 22 as described above, the amount of the refrigerant circulating in the refrigerant circuit 9 is increased and thus the refrigerant material (R134a) having a high boiling point which is harder to evaporate in the non-azeotropic mixture refrigerant (R407C) is stocked in the accumulator 17 while the refrigerant materials (R125 and R32) having low boiling points which are more liable to evaporate are circulated in the refrigerant circuit 9. Accordingly, the composition of the refrigerant circulated in the refrigerant circuit 9 is varied. As a result, the evaporation of the refrigerant in the indoor heat exchanger 21 is promoted and the refrigerant pressure in the indoor heat exchanger is increased, thereby suppressing occurrence of freezing in the indoor heat exchanger 21.

Further, the increase of the valve opening degree of the expansion valve 22 lowers the pressure-reducing level of the refrigerant by the expansion valve 22, so that the refrigerant pressure in the indoor heat exchanger 21 is increased and thus the refrigerant temperature is increased, whereby the occurrence of freezing in the indoor heat exchanger 21 can be further suppressed.

Subsequently, the controller 13 judges whether the indoor heat exchanger refrigerant temperature detected by, the indoor heat exchanger temperature sensor 27 is further reduced to a second predetermined temperature (lower than the first predetermined temperature) or less (for example, 0° C. or less) (S5). If the indoor heat exchanger refrigerant temperature is below 0° C., the controller 13 controls to increase the number of revolution of the indoor fan 23 (S6). When the number of revolution of the indoor fan 23 is set to three stepwise levels of "strong blow", "middle blow" and "weak blow" in the blow-intensity decreasing order, the controller 13 sets the number of revolution of the indoor fan 23 from "weak blow" to "middle blow".

When the number of revolution of the indoor fan 23 is increased, the refrigerant in the indoor heat exchanger 21 is more liable to evaporate, so that the refrigerant pressure in the indoor heat exchanger 21 is increased and the refrigerant temperature is increased thereby suppressing the occurrence of freezing in the indoor heat exchanger 21. This freezing suppressing effect further promotes the freezing suppressing effect achieved due to the composition variation effect that the main refrigerant flowing in the indoor heat exchanger 21 is the refrigerant materials having the low boiling points (R125 and R35).

Therefore, according to this embodiment, the following effects can be achieved.

(1) In the cooling operation under the low ,outside temperature state, the refrigerant having the high boiling point in the non-azeotropic mixture refrigerant is stocked in the accumulator 17, and the refrigerant having the low boiling point in the non-azeotropic mixture refrigerant is circulated in the refrigerant circuit. Therefore, the refrigerant in the indoor heat exchanger serving as the evaporator in the cooling operation is more liable to evaporate, and thus the refrigerant pressure in the indoor heat exchanger 21 is increased, so that the occurrence of freezing in the indoor heat exchanger 21 can be suppressed in the cooling operation under the low outside temperature state. Accordingly, the frequency at which the compressor 16 is stopped because the breaking of the indoor heat exchanger 21 and the breaking of the compressor due to liquid-back are prevented when freezing occurs can be reduced. Therefore, even when any non-azeotropic mixture refrigerant is used, the cooling operation can be continuously performed even when the outside temperature is low. As a result, a stable cooling effect can be achieved and an excellent comfortable environment can be achieved.

(2) When the cooling operation is carried out under the state that the outside temperature is low, the refrigerant having the high boiling point is stocked in the accumulator 17. Therefore, any, receiver which has been hitherto disposed to avoid the refrigerant from being stocked in the accumulator 17 is not required, and this enables omission of a pressure-reducing mechanism such as an expansion valve or the like which has been hitherto disposed in the neighborhood of the outdoor heat exchanger 19 because the receiver tank is disposed. As a result, the refrigerant circuit 9 can be simplified in construction and the cost of the air conditioner 10 can be lowered.

(3) When the number of revolution of the indoor fan 23 for blowing air to the indoor heat exchanger 21 is increased, the refrigerant flowing in the indoor heat exchanger 21 is more liable to evaporate, so that the refrigerant pressure in the indoor heat exchanger 21 is increased and the refrigerant temperature is also increased. As a result, by circulating the refrigerant having the low boiling point in the non-azeotropic mixture refrigerant, the refrigerant pressure in the indoor heat exchanger 21 is increased, whereby the occurrence of the freezing in the indoor heat exchanger 21 can be more surely suppressed in cooperation with the effect (1) of suppressing the occurrence of the freezing in the indoor heat exchanger 21.

As described above, according to this embodiment, in the air conditioner in which the non-azeotropic mixture refrigerant is circulated in the refrigerant circuit, in the cooling operation under the low outside temperature state, the refrigerant having the high boiling point in the non-azeotropic mixture refrigerant is stocked in the accumulator while the refrigerant having the low boiling point is circulated in the refrigerant circuit, so that the occurrence of the freezing in the indoor heat exchanger can be suppressed in the cooling operation under the low outside temperature state and thus the stable cooling effect can be achieved even when non-azeotropic mixture refrigerant is used.

Figure 3:
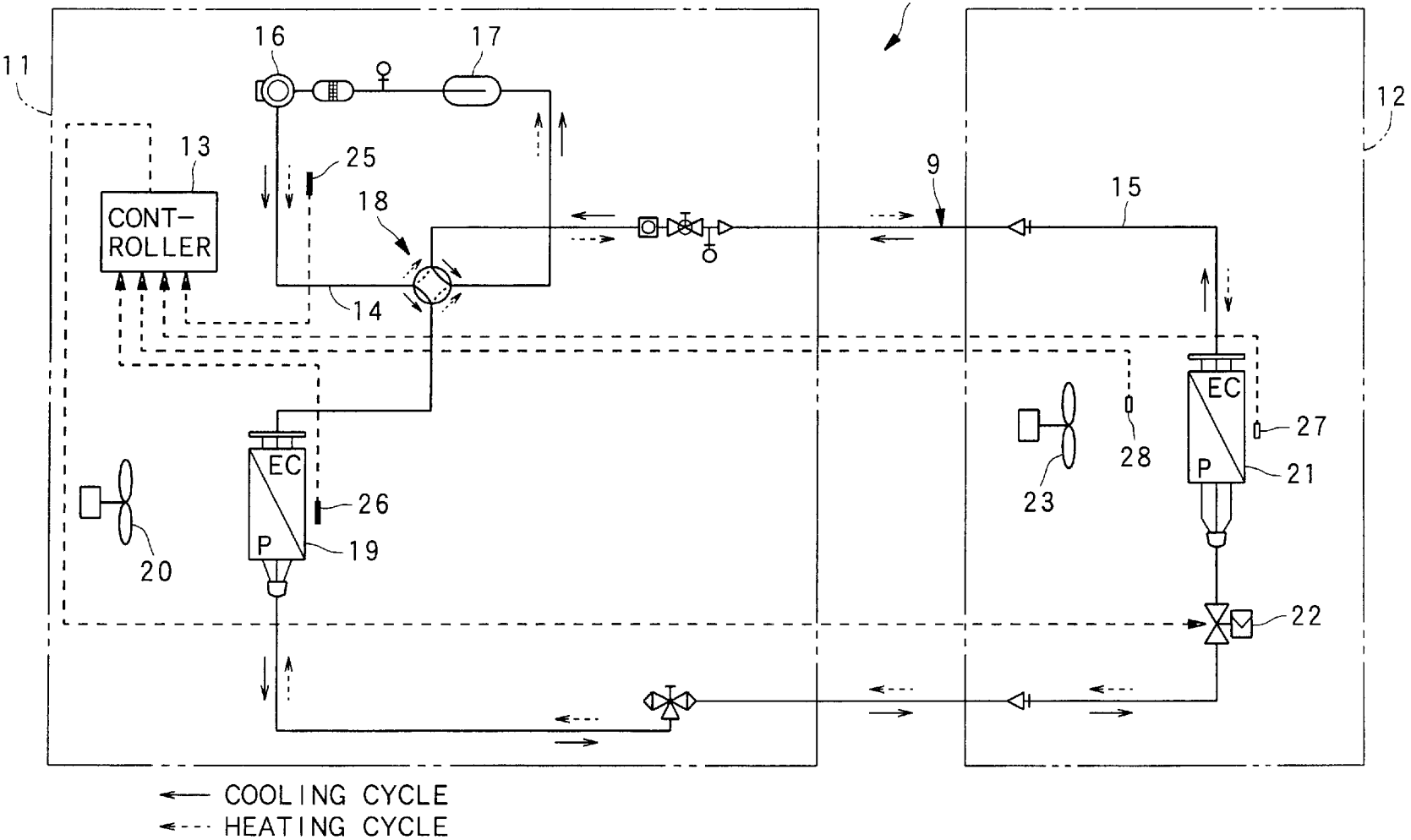
FIG. 3 is a diagram showing a refrigerant circuit according to a second embodiment of the air conditioner of the present invention.

FIG. 3 is a diagram showing a refrigerant circuit according to a second embodiment of the air conditioner of the present invention. The refrigerant circuit of FIG. 3 is substantially the same construction as the first embodiment, and only the different points will be:: described. The same parts are represented by the same reference numerals, and the description thereof is omitted.

In this embodiment, under heating operation, the controller 13 adjusts the valve opening degree of the expansion valve 22 as described later to perform a discharged refrigerant temperature control operation.

That is, under the heating operation, the controller 13 carries out the following discharged refrigerant temperature control operation to stock the refrigerant (R134a) having the high boiling point in the non-azeotropic mixture refrigerant into the accumulator and circulating the refrigerant having the low boiling point (R125 and R32) in the refrigerant circuit 9, thereby varying the composition of the refrigerant circulated in the refrigerant circuit 9.

In order to perform the discharged refrigerant temperature control operation, the temperature of sucked air to the indoor heat exchanger 21 (that is, the room temperature) is detected by a room temperature sensor 28, and the sucked air temperature thus detected is input to the controller 13. Further, the temperature of the discharged refrigerant from the compressor 16 (that is, the actual discharged refrigerant temperature) is detected by a discharged refrigerant temperature sensor 25, and the actual discharged refrigerant temperature thus detected is input to the controller 13. Still further, the temperature of the refrigerant flowing at the middle position between the inlet and outlet ports of the outdoor heat exchanger 19 (that is, the outdoor heat exchanger refrigerant temperature) is detected by an outdoor heat exchanger temperature sensor 26, and the outdoor heat exchanger refrigerant temperature thus detected is input to the controller 13. In addition, the temperature of the refrigerant flowing at the middle position between the inlet and output ports of the indoor heat exchanger 21 (that is, the indoor heat exchanger refrigerant temperature) is detected by an indoor heat exchanger temperature sensor 27, and the indoor heat exchanger refrigerant temperature thus detected is input to the controller 13.

Figure 4:
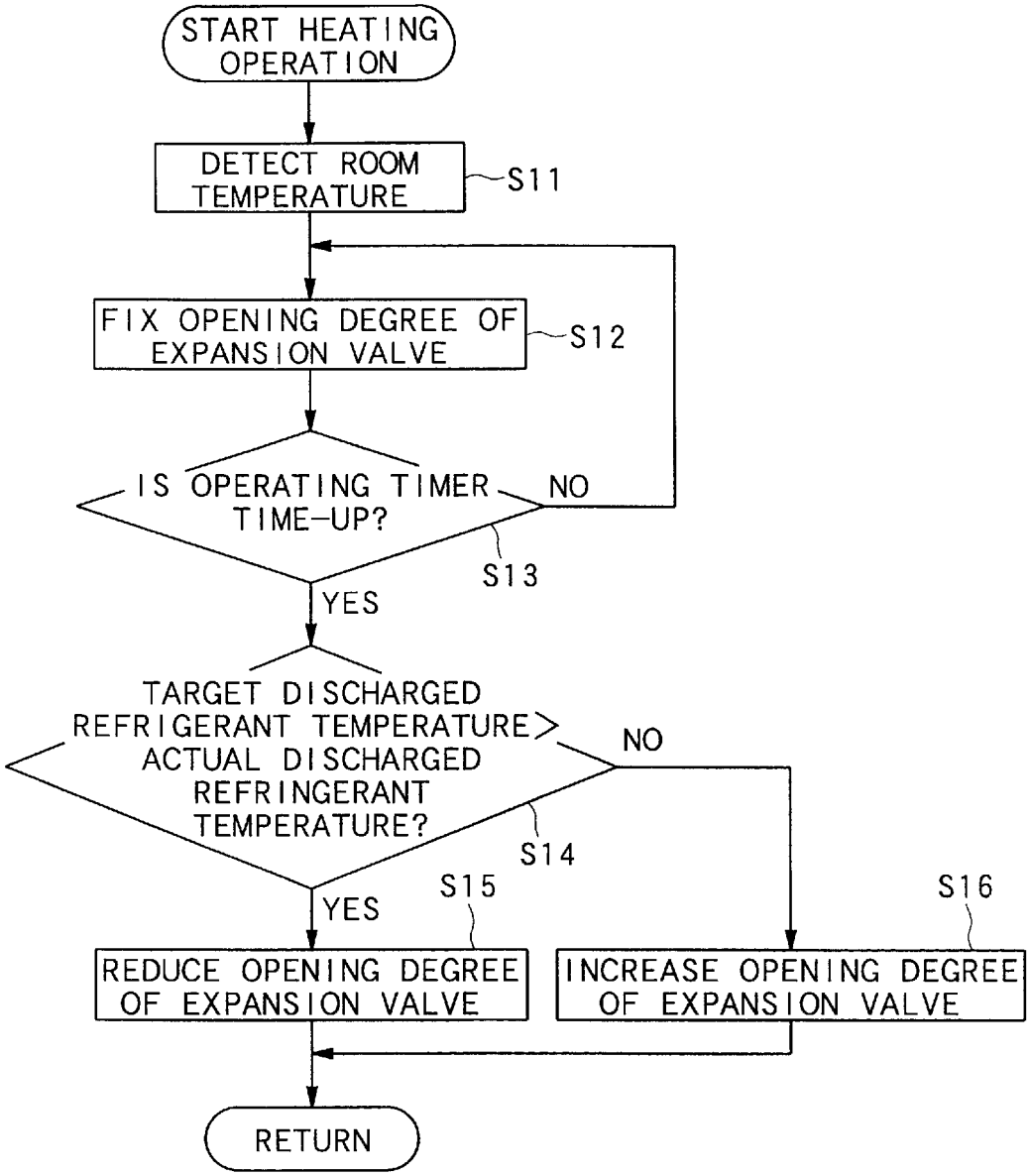
FIG. 4 is a flowchart showing discharged refrigerant temperature control in heating operation of the air conditioner shown in FIG. 3.

The controller 13 carries out the following discharged refrigerant temperature control operation under the heating operation. As show in the flowchart of FIG. 4, the controller 13 first detects the room temperature by using the room temperature sensor for a predetermined time (for example, several minutes) after the heating operation is started (S11), and sets the valve opening degree of the expansion valve 22 to a fixed opening degree which is determined on the basis of the room temperature detected by the room temperature sensor 28 (S12).

The fixed opening degree is determined so that the refrigerant having the high boiling point (R134a) in the non-azeotropic mixture refrigerant is stocked in the accumulator 17. Therefore, when the expansion valve 22 is set to the fixed opening degree, the refrigerant having the high boiling point (R134a) which is harder to evaporate is stocked in the accumulator 17, and the refrigerant having the low boiling point (R125 and R32) which is more liable to evaporate is circulated in the refrigerant circuit 9, so that the composition of the refrigerant circulating in the refrigerant circuit 9 is varied.

At this time, when a built-in operating timer (not shown) of the controller 13 detects the lapse of the above predetermined time (several minutes) after the start of the heating operation (S13), the controller 13 subsequently detects the temperature of the refrigerant discharged from the compressor 16 by the discharged refrigerant temperature sensor 25, and compares the actual discharged refrigerant temperature thus detected with a target discharged refrigerant temperature (S14).

The target discharged refrigerant temperature is determined on the basis of a calculation equation using as parameters the outdoor heat exchanger refrigerant temperature detected by the outdoor heat exchanger temperature sensor 26 and the indoor heat exchanger refrigerant temperature detected by the indoor heat exchanger temperature sensor 27. The target discharged refrigerant temperature is set so that R134a is continuously stocked in the accumulator 17, for example, the degree of superheat SH of the suction of the compressor 16 is set to −1° C.

Subsequently, if it is judged in step S 14 that the actual discharged refrigerant temperature is lower than the target discharged refrigerant temperature (the judgment in step S14: YES), the controller 13 reduces the valve opening degree of the expansion valve 22 to lower the amount of the refrigerant circulating in the refrigerant circuit 9 (S15). On the other hand, if it is judged in step S14 that the actual discharged refrigerant temperature is not lower than the target discharged refrigerant temperature (the judgment in step S14:NO), the controller 13 increases the valve opening degree of the expansion valve 22 to increase the amount of the refrigerant circulating in the refrigerant circuit 9 (step S16). Through this operation, R134a is stocked in the accumulator while R125 and R32 are circulated in the refrigerant circuit 9.

Through the above discharged refrigerant temperature control operation, the refrigerant circulated in the refrigerant circuit 9 varies in composition (i.e., the refrigerant containing R134a, R125 and R32 is varied to the refrigerant containing R125 and R32), and thus the refrigerant in the outdoor heat exchanger 19 serving as the evaporator in the heating operation is more liable to evaporate as compared with R407C containing R134a, R125 and R32, that is, before the composition of the refrigerant is varied). Therefore, the refrigerant pressure in the outdoor heat exchanger 19 is increased, and thus occurrence of frost in the outdoor heat exchanger 19 can be suppressed. At the same time, with the refrigerant after the composition is varied, the refrigerant pressure in the indoor heat exchanger 21 serving as the condenser is increased to a value higher than that before the composition is varied, so that the heating power of the indoor heat exchanger 21 is enhanced.

Accordingly, according to this embodiment, the following effects (1) and (2) are achieved. (1) Under the heating operation, the refrigerant having the high boiling point (R134a) in the non-azeotropic mixture refrigerant (R407C) is stocked in the accumulator 17, and the refrigerant having the low boiling point (R125 and R32) is circulated in the refrigerant circuit 9. Therefore, the refrigerant is more liable to evaporate in the outdoor heat exchanger 19 serving as the evaporator under the heating operation, and thus the refrigerant pressure in the outdoor heat exchanger 19 is increased, thereby preventing occurrence of frost in the outdoor heat exchanger 19. Therefore, the ratio of the defrosting time to the overall heating operation can be reduced. Further, since the refrigerant having the low boiling refrigerant is circulated in the refrigerant circuit 9 under the heating operation, the refrigerant pressure in the indoor heat exchanger 21 serving as the condenser is increased and thus the heating power of the indoor heat exchanger 21 is enhanced. As a result, the overall heating power of the air conditioner 10 under the heating operation can be enhanced.

(2) Under the heating operation, the refrigerant having the high boiling point (R134a) is stocked in the accumulator 17, and thus any receiver tank which has been hitherto disposed to avoid the refrigerant from being stocked in the accumulator 17 is not required. In addition, any pressure-reducing mechanism (for example, expansion valve) which has been hitherto disposed in the neighborhood of the outdoor heat exchanger 19 due to the mount of the receiver tank is not required. Therefore, the refrigerant circuit 9 can be simplified in construction and the cost of the air conditioner 10 can be lowered.

As described above, according to the second embodiment of the present invention, in the air conditioner in which the non-azeotropic mixture refrigerant is circulated in the refrigerant circuit, under the heating operation, the refrigerant having the boiling point in the non-azeotropic mixture refrigerant is stocked in the accumulator while the refrigerant having the low boiling point is circulated in the refrigerant circuit. Therefore, even when the non-azeotropic mixture refrigerant is used, the outdoor heat exchanger can be prevented from being frosted in the heating operation, and thus the heating power can be enhanced.

The present invention is not limited to the above embodiments, and various modifications may be made without departing from the subject matter of the present invention. For example, in the above embodiments, R407C is used as the non-azeotropic mixture refrigerant, however, other kinds of materials such as R410A, etc. may be used as the non-azeotropic mixture refrigerant.

What is claimed is:

1. An air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of first refrigerant having a high boiling point and second refrigerant having a low boiling point being filled in the refrigerant circuit and the flow of the non-azeotropic mixture refrigerant being inverted between cooling operation and heating operation by operating the four-way valve, characterized in that when one of said outdoor heat exchanger and said indoor heat exchanger serves as an evaporator, the first refrigerant of the non-azeotropic mixture refrigerant is stocked in said accumulator while the second refrigerant of the non-azeoptropic mixture refrigerant is circulated in said refrigerant circuit, thereby mixture refrigerant is stocked in said accumulator while the second refrigerant of the non-azeotropic mixture refrigerant is circulated in:said refrigerant circuit, thereby increasing the refrigerant pressure in the evaporator, wherein said pressure-reducing mechanism comprises an expansion valve, and the stock of the first refrigerant into said accumulator is-performed by increasing the value opening degree of said expansion valve when the temperature of the refrigerant flowing in said indoor heat exchanger is equal to a first predetermined temperature or less, wherein when the temperature of the refrigerant flow in said indoor heat exchanger is equal to a second predetermined temperature or less, the second predetermined temperature being lower than the first predetermined temperature, the number of revolution of an indoor fan for blowing air to said indoor hear exchanger is increased to increase the pressure of the refrigerant in said evaporator.

2. An air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of first refrigerant having a high boiling point and second refrigerant having a low boiling point being filled in the refrigerant circuit and the flow of the non-azeotropic mixture refrigerant being inverted between cooling operation and heating operation by operating the four-way valve, characterized in that when one of said outdoor heat exchanger and said indoor heat exchanger serves as an evaporator, the first refrigerant of the non-azeotropic mixture refrigerant is stocked in said accumulator while the second refrigerant of the non-azeoptropic mixture refrigerant is circulated in said refrigerant circuit, thereby increasing the refrigerant pressure in said evaporator, wherein when the outside temperature is low in cooling operation, the first refrigerant of the non-azeotropic mixture refrigerant is stocked in said accumulator while the second refrigerant of the non-azeotropic mixture refrigerant is circulated in said refrigerant circuit, thereby increasing the refrigerant pressure in the evaporator, wherein the number of revolution of an outdoor fan for blowing air to said outdoor heat exchanger serving as an evaporator is set to any one of plural levels in accordance with the outside temperature to increase the pressure of the refrigerant in said evaporator.

3. An air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of first refrigerant having a high boiling point and second refrigerant having a low boiling point being filled in the refrigerant circuit and the flow of the non-azeotropic mixture refrigerant being inverted between cooling operation and heating operation by operating the four-way valve, characterized in that when one of said outdoor heat exchanger and said indoor heat exchanger serves as an evaporator, the first refrigerant of the non-azeotropic mixture refrigerant is stocked in said accumulator while the second refrigerant of the non-azeoptropic mixture refrigerant is circulated in said refrigerant circuit, thereby increasing the refrigerant pressure in said evaporator, wherein in heating operation, the first refrigerant of the non-azeotropic mixture refrigerant is stocked in said accumulator while the second refrigerant of the non-azeotropic mixture refrigerant is circulated in said refrigerant circuit, thereby increasing the refrigerant pressure in said evaporator, wherein said pressure-reducing mechanism comprises an expansion valve, and the stock of the first refrigerant into said accumulator is performed by setting the valve opening degree of said expansion valve on the basis of the room temperature when the heating operation is started and on the basis of a target discharged refrigerant temperature after a predetermined time elapses from the start of the heating operation.

4. The air conditioner as claimed in claim 3, wherein the stock of the first refrigerant into the accumulator on the basis of the room temperature is performed by setting the valve opening degree of said expansion valve to a predetermined fixed opening degree.

5. The air conditioner as claimed in claim 3, wherein the stock of the first refrigerant into the accumulator is performed by setting the valve opening degree of said expansion valve on the basis of the temperature difference between the actual discharged refrigerant temperature of the refrigerant discharged from said compressor and a predetermined target discharged refrigerant temperature so that the temperature difference is equal to zero.

6. An air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of at least one first refrigerant having a high boiling point and at least one second refrigerant having a low boiling point being filled in the refrigerant circuit and the flow of the non-azeotropic mixture refrigerant being inverted between cooling operation and heating operation by operating the four-way valve, characterized by further including: a controller for controlling the pressure-reducing degree of said pressure-reducing mechanism so that when one of said outdoor heat exchanger and said indoor hear exchanger serves as an evaporator and when the heating operation is carried out or the cooling operation under a low outside temperature is carried out, the first refrigerant of the non-azeotropic mixture refrigerant is stocked in said accumulator and the second refrigerant of the non-azeotropic mixture refrigerant is circulated in said refrigerant circuit, thereby increasing the refrigerant pressure in said evaporator, wherein said pressure-reducing mechanism comprises an expansion valve, and the stock of the first refrigerant into said accumulator is performed by increasing the value opening degree of said expansion valve when the temperature of the refrigerant flowing in said indoor heat exchanger is equal to a first predetermined temperature or less, wherein when the temperature of the refrigerant flow in said indoor heat exchanger is equal to a second predetermined temperature or less, the second predetermined temperature being lower than the first predetermined temperature, the number of revolution of an indoor fan for blowing air to said indoor hear exchanger is increased to increase the pressure of the refrigerant in said evaporator.

7. An air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of at least one first refrigerant having a high boiling point and at least one second refrigerant having a low boiling point being filled in the refrigerant circuit and the flow of the non-azeotropic mixture refrigerant being inverted between cooling operation and heating operation by operating the four-way valve, characterized by further including: a controller for controlling the pressure-reducing degree of said pressure-reducing mechanism so that when one of said outdoor heat exchanger and said indoor hear exchanger serves as an evaporator and when the heating operation is carried out or the cooling operation under a low outside temperature is carried out, the first refrigerant of the non-azeotropic mixture refrigerant is stocked in said accumulator and the second refrigerant of the non-azeotropic mixture refrigerant is circulated in said refrigerant circuit, thereby increasing the refrigerant pressure in said evaporator, wherein the number of revolution of an outdoor fan for blowing air to said outdoor heat exchanger serving as an evaporator is set to any one of plural levels in accordance with the outside temperature to increase the pressure of the refrigerant in said evaporator.

8. An air conditioner including a compressor, a four-way valve, an outdoor heat exchanger, a pressure-reducing mechanism, an indoor heat exchanger and an accumulator which are successively connected to one another to construct a loop-like refrigerant circuit, non-azeotropic mixture refrigerant composed of at least one first refrigerant having a high boiling point and at least one second refrigerant having a low boiling point being filled in the refrigerant circuit and the flow of the non-azeotropic mixture refrigerant being inverted between cooling operation and heating operation by operating the four-way valve, characterized by further including: a controller for controlling the pressure-reducing degree of said pressure-reducing mechanism so that when one of said outdoor heat exchanger and said indoor hear exchanger serves as an evaporator and when heating operation is carried out, the first refrigerant of the non-azeotropic mixture refrigerant is stocked in said accumulator and the second refrigerant of the non-azeotropic mixture refrigerant is circulated in said refrigerant circuit, thereby increasing the refrigerant pressure in said evaporator, wherein said pressure-reducing mechanism comprises an expansion valve, and the stock of the first refrigerant into said accumulator is performed by setting the valve opening degree of said expansion valve on the basis of the room temperature when the heating operation is started and one the basis of a target discharged refrigerant temperature after a predetermined time elapses from the start of the heating operation.

* * * * *